US005357490A

United States Patent [19]

Kashine

[11] Patent Number: 5,357,490

[45] Date of Patent: Oct. 18, 1994

[54] MEASURING TIMER SYSTEM

[75] Inventor: Takashi Kashine, Hyogo, Japan

[73] Assignee: Mitsubishi Denki Kabushiki Kaisha, Japan

[21] Appl. No.: 922,457

[22] Filed: Jul. 30, 1992

[30] Foreign Application Priority Data

Aug. 1, 1991 [JP] Japan ..... 3-215854

[51] Int. Cl.[5] ..... G04F 8/00; G04F 10/00

[52] U.S. Cl. ..... 368/119

[58] Field of Search ..... 368/117, 118, 119, 120, 368/113

[56] References Cited

U.S. PATENT DOCUMENTS 3,037,166 5/1962 Alexander ..... 368/118
3,218,553 11/1965 Peterson et al. ..... 368/119
3,887,870 6/1975 Grosseau ..... 324/76.62
4,234,881 11/1980 Stauers ..... 342/115
4,737,942 4/1988 Nishibe ..... 368/118

*Primary Examiner*—Bernard Roskoski
*Attorney, Agent, or Firm*—Townsend and Townsend, Khourie and Crew

[57] ABSTRACT

Accurate measurement results can be obtained without increasing the number of bits of a timer. A timer 1 performs counting with low-speed clocks immediately after input pulse is inputted. When the value counted by the timer with the low-speed clock coincides with the set value of a switching set value register 4, high-speed clocks are inputted. to the timer 1 by a clock switching circuit 6 which is switched by the output of a comparison circuit 5.

1 Claim, 3 Drawing Sheets

MEASURING TIMER SYSTEM

BACKGROUND OF THE INVENTION

1. Field of the Invention

The present invention relates to a measuring timer system for measuring the period of input pulse signals, particularly measurement of a slight error of the period when the period value is roughly estimated.

2. Description of the Prior Art

FIG. 3 shows a circuit block diagram of an existing measuring timer system for measuring the period of input pulse signals. In FIG. 3, numeral 1 is a timer for measuring the period of input pulse signals, 2 is a measurement result register for holding measurement results, and 1S is a switch.

FIG. 4 shows the timing for measurement.

The following is the description of operation. When the input pulse signal changes (point "a" in FIG. 4) (detected at the leading edge of the input pulse signal), the timer 1 is reset start counting from the initial value. When the input pulse signal changes next (point "b" in FIG. 4), the switch 1S is turned on to hold the then counted value as a measurement result before resetting the timer 1. The above operation is repeated every input pulse signal period.

A slight error may occur in the period of the input pulse signal. In this case, the error can accurately be measured by increasing the clock speed.

Problem to Be Solved by the Invention

Because the existing measuring timer system is constituted as described above, the number of bits comprising the flip flop of the timer 1 must be increased by a value equivalent to the increase of the clock speed in order to accurately measure the input pulse signal period. That is, when clock is high-speed, the value counted by the clock is unavoidably increased. Therefore, to correspond to the increase of the counted value, the number of bits of the timer must be increased.

SUMMARY OF THE INVENTION

Object

The present invention is made to solve the above problem and its object is to provide a measuring timer system capable of obtaining accurate measurement results without increasing the number of bits of the timer.

Means for Solving the Problem

The measuring timer system of the present invention has the timer 1 for counting count clocks of a constant period between previous and subsequent input pulses consecutively inputted and outputs the value counted by the timer as the periled of the input pulse, in which high-speed clocks are inputted as the count clock when the predetermined time Tc elapses after the previous input pulse is inputted.

The measuring timer system prepares high-speed and low-speed clocks and, moreover, a first storing means for storing switching set values, inputs low-speed clocks to the timer as the count clock at the beginning, and has a clock switching means (clock switching circuit 5) for switching low-speed clocks to high-speed clocks in accordance with the output of a comparing means (comparison circuit 5) for outputting a switching signal when the low-speed clock reaches the set value of the first storing means and a gate means (OR gate la) for outputting a reset signal to the timer when the clock is switched.

The measuring timer system includes a switching set value register 4 storing external units.

Function

The measuring timer system starts counting with high-speed clocks when the predetermined time Tc elapses after an input pulse is inputted. That is, the bits of the timer up to the predetermined time Tc are not required.

The measuring timer system performs counting with low-speed clocks up to the predetermined time Tc.

The measuring timer system makes it possible to optionally change the predetermined time Tc or the switching set value in the switching set value register with an external unit such as a CPU or peripheral unit.

The above and other objects, features, and advantages of the invention will become more apparent from the following description when taken in conjunction with the accompanying drawings.

DESCRIPTION OF THE PREFERRED EMBODIMENT

Embodiment 1

Figure 1:
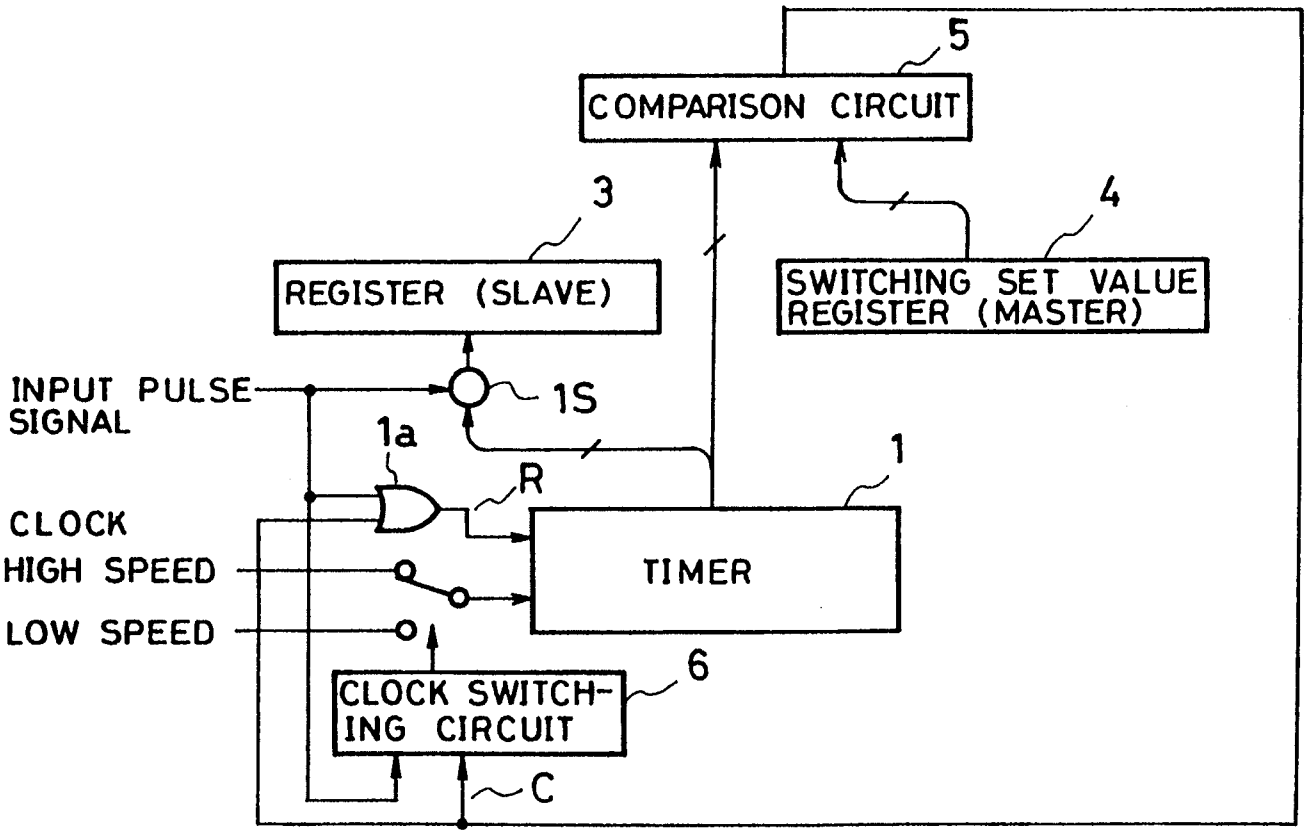
FIG. 1 is a block diagram showing the circuit constitution an embodiment of the measuring timer system of the present invention.
Figure 2:
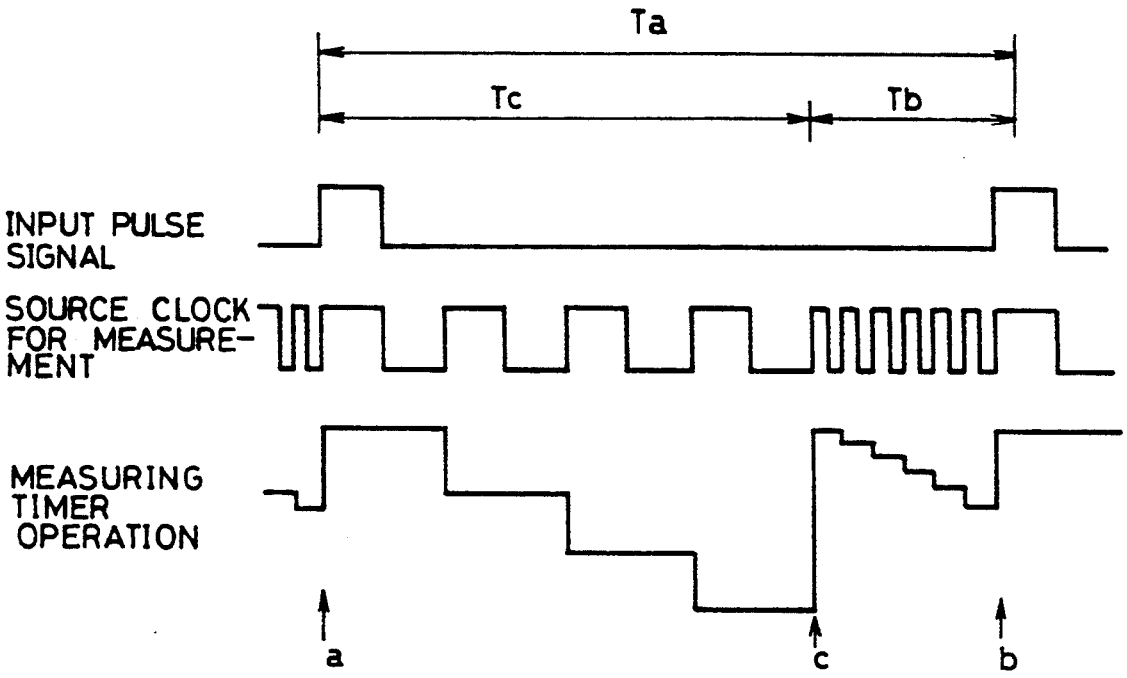
FIG. 2 is a timing chart showing the operation of an embodiment of the measuring timer system of the present invention.
Figure 3:
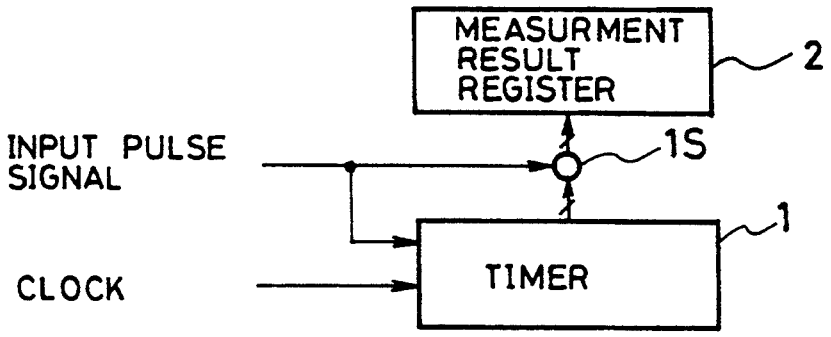
FIG. 3 PRIOR ART
FIG. 3 is a block diagram showing a circuit constitution of an existing measuring timer system.
Figure 4:
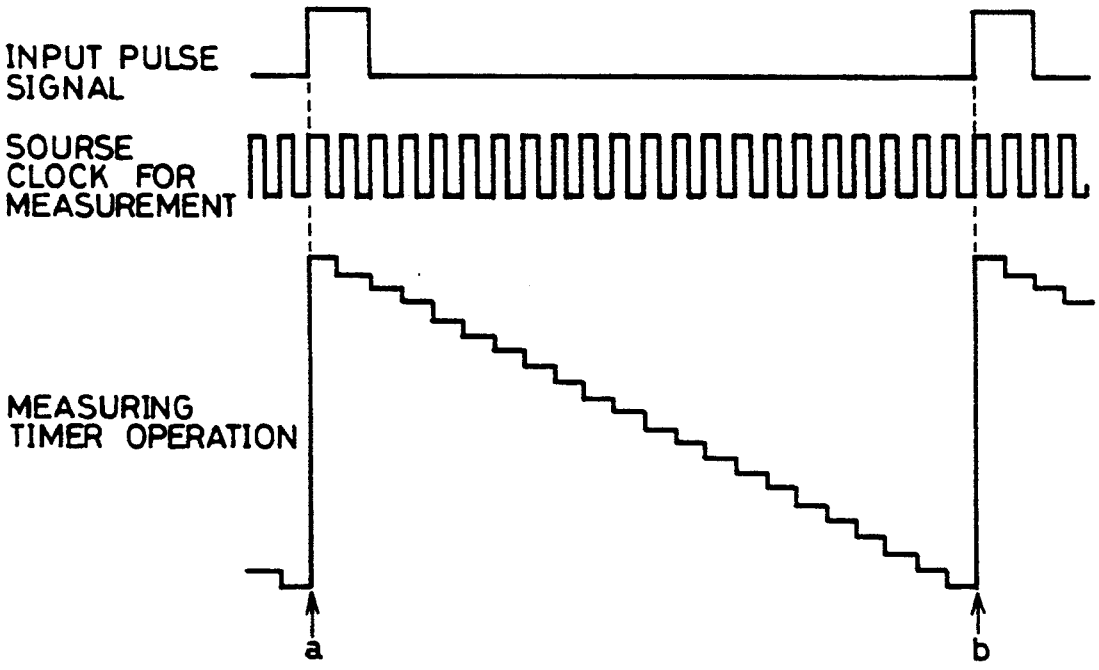
FIG. 4 PRIOR ART
FIG. 4 is a timing chart showing the operation of an existing measuring timer system.

The following is the description of an embodiment of the present invention. In FIG. 1, numeral 1 is a timer for measuring the period of input pulse signals, 1*a* is an OR gate for outputting reset signals to the timer 1, 3 is a register (second storing means) for holding the lower order of measurement results, 4 is switching set value register for storing the time Tc (switching set value) which is shorter by the time Tb than the estimated period Ta of the previous and subsequent input pulse signals consecutively inputted, 5 is a comparison circuit for comparing the contents of the switching set value register (first storing means) 4 with those of the timer 1, and 6 is a clock switching circuit for switching the clock of the timer 1. FIG. 2 shows the timing for measurement.

The following is the description of operation. When the input pulse signal changes (rises) (point "a" in FIG. 2), low-speed clock is selected as the clock for the timer 1 by the clock switching circuit 6 and the timer 1 reset by the reset signal R sent from the OR gate 1*a* starts counting.

Moreover, when the contents of the switching set value register 4 to which the time Tc shorter by the time Tb than the roughly estimated value Ta of the input pulse signal period is set coincide with those of the counted value of the timer 1 (point "c" in FIG. 2), a switching signal is outputted to the clock switching circuit 6, high-speed clock is selected as the clock for the timer 1, and the timer 1 is reset by the reset signal R sent from the OR gate 1*a* to start counting from the initial value.

Then, counted values measured by high-speed clocks for the time Tb are held by the register 3 as low order of measurement results through the switch 1S at the next input pulse signal change point (point "b" in FIG. 2) and the timer 1 starts counting from the initial value.

As the result of the above operation, the contents of the switching set value register 4 and those of the register 3 are put together to obtain measurement results.

The contents of the switching set value register 4 can be changed by an external unit such as a CPU or peripheral unit.

As described above, because the timer 1 counts low-speed clocks for the time Tc, the counted number of high-speed clocks decreases. Therefore, the number of bits of the timer 1 can be decreased by a value equivalent to the decrease of high-speed clocks and accurate measurement can be performed. Though the existing timer 1 requires 16 bits, the timer of the present invention requires only 8 bits.

For the above embodiment, the time Tc is detected by continuing counting until the low-speed clock reaches the switching set value. However, it is also possible to detect the time Tc by other timer means. For example, the time Tc can be detected by dividing the clock for driving a CPU with a frequency divider or by using a CR circuit or a timer externally attached to a microcomputer. It is also possible to use a constitution in which the time Tc is detected when a CPU executes a certain program routine. For this constitution, the number of bits of the timer 1 can further be decreased because the timer 1 does not perform counting until the predetermined time Tc elapses.

Advantage of the Invention

As described above, the measuring timer system of the present invention makes it possible to make measurement at a high accuracy without increasing the number of bits of a timer because high-speed clocks are inputted when the predetermined time Tc elapses after input pulse is inputted.

Moreover, the number of bits of the timer can further be decreased compared with the case in which only high-speed clocks are used because counting is performed by low-speed clocks until the predetermined time Tc elapses.

Furthermore, because the switching set value or the predetermined time Tc is stored in a register, the time Tc can optionally be changed by an external unit.

What is claimed is:

1. An improved time measuring system for measuring the time period between previous and subsequent input pulses comprising:

a timer having a reset input for resetting a timer count value, a clock input for incrementing said timer count value, and a timer count value output indicating said timer count value;

a clock signal switch, having inputs coupled to receive high speed and low speed clock signals, for selectively outputting one of said clock signals to said clock input in response to the setting or resetting of a control signal;

a slave register coupled to said count value output for storing a count value of the high-speed clock pulses from said count value output;

a switching value register for storing a predetermined count value equal to a number of low speed clock cycles that equal a predetermined time interval that is smaller than the time interval between the previous and subsequent input pulses;

a comparison circuit, having inputs coupled to receive said predetermined count value stored in said switching value register and said timer count value from said timer, for setting a coincidence signal when said predetermined count value and said timer count value coincide, said control signal derived from said coincidence signal to reset said timer and select the high-speed clock signal.

* * * * *